United States Patent [19]

Trujillo

[11] 3,999,331

[45] Dec. 28, 1976

[54] APPARATUS FOR MAKING HIGH-PRESSURE PORTS IN CLOSED HULLS

[75] Inventor: Louis J. Trujillo, San Diego, Calif.

[73] Assignee: The United States of America as represented by the Secretary of the Navy, Washington, D.C.

[22] Filed: Aug. 4, 1975

[21] Appl. No.: 601,970

[52] U.S. Cl. ..... 51/241 S

[51] Int. Cl.[2] ..... B24B 23/08

[58] Field of Search ..... 51/241 R, 241 S, 241 US, 51/241 A; 90/12.5, DIG. 23

[56] References Cited

UNITED STATES PATENTS

| | | | |
|---|---|---|---|
| 692,459 | 2/1902 | Langlois | 90/DIG. 23 |
| 935,291 | 9/1909 | Boenig | 51/241 S |
| 1,278,607 | 9/1918 | De Forest | 90/DIG. 23 |
| 1,371,484 | 3/1921 | Howard | 90/DIG. 23 |
| 1,435,502 | 11/1922 | Sager | 51/241 S |
| 2,180,640 | 11/1939 | Mikalson | 51/241 S |
| 2,491,565 | 12/1949 | Johnson | 51/241 S |
| 2,908,120 | 10/1959 | Jensen | 51/241 VS |

FOREIGN PATENTS OR APPLICATIONS

| | | | |
|---|---|---|---|
| 23,913 | 11/1908 | United Kingdom | 51/241 VS |

*Primary Examiner*—Al Lawrence Smith
*Assistant Examiner*—Nicholas P. Godici
*Attorney, Agent, or Firm*—Richard S. Sciascia; Ervin F. Johnston; William T. Skeer

[57] ABSTRACT

An in situ refurbishing system for viewing ports aboard pressure-tight hulls includes a guide shaped to cooperate with the viewing port and provide a datum axis centered thereon. An axle is rotatably supported by the guide and carries a lapping tool in polishing engagement with the port. Centering guides permit adjustment of the datum axis and pressure means exert a uniform engagement pressure with the lapping tool such that optical quality surfaces may be obtained without extensive dismantling and use of shipyard time.

6 Claims, 8 Drawing Figures

APPARATUS FOR MAKING HIGH-PRESSURE PORTS IN CLOSED HULLS

STATEMENT OF GOVERNMENT INTEREST

The invention described herein may be manufactured and used by or for the Government of the United States of America for governmental purposes without the payment of any royalties thereon or therefor.

FIELD OF THE INVENTION

This invention pertains to naval architecture and marine engineering sciences. In greater particularly, this invention pertains to the fabrication and repair of deep submergence vehicles. In still greater particularity, the invention pertains to tools used to obtain a pressure-tight seal about hull penetrating ports. By way of further explanation, but without specific limitation thereto, the invention pertains to an in situ refurbishing tool for establishing a pressure-tight seal for viewing ports within the hull of personnel transport capsules and decompression chambers.

DESCRIPTION OF THE PRIOR ART

Personnel transfer capsules and decompression chambers aboard ships which are used in deep ocean diving systems are relatively new in the art and do not have a long established maintenance technique. However, each of these personnel compartments weigh several tons and whereas the former are moveable to a limited extent, the latter are mounted beneath the weather deck within the confines of the hulls of ocean going vessels. Thus, when the need has arisen to refurbish or repair these compartments they have been returned to their manufacturers and the manufacturing steps have been repeated to effect a repair for lack of pressure integrity. Particularly in the case of decompression chambers, this has required considerable yard time by the vessel in which it is mounted. The present cost of extensive time in naval yards have made such repairs extremely costly.

SUMMARY OF THE INVENTION

The invention makes possible the repair of viewing ports and other hull penetrating passages without removal of the personnel compartments from on board ship or the detention of the ship in a shipyard or dry dock. This is made possible by the removal of the port hole lens and replacement with a guide which provides an axially rotatable mounting for a grinding and lapping tool which then engages the damaged area of the viewing port to restore its mechanical finish and, hence, its pressure integrity. A magnetic location and attachment of the guide means additionally establishes a working engagement drive which maintains a predetermined tool engagement pressure between the portion of the port being resurfaced and the grinding tool supported by the guide. Additionally, a resilient tool engagement provision is provided as a selected alternative.

STATEMENT OF THE OBJECTS OF THE INVENTION

It is accordingly an object of this invention to provide an improved metal working tool.

A further object of this invention is to provide a metal working tool for use on board naval vessels.

Yet another object of this invention is to provide a refurbishing system for viewing ports.

It is another object of this invention to provide for an in situ refurbishing system for high pressure viewing ports.

Yet another object of this invention is to provide a refurbishing tool for resurfacing damaged viewing ports within high pressure marine hulls.

These and other objects of the invention will become more readily apparent from the ensuring specification when taken together with the drawings.

DESCRIPTION OF THE PREFERRED EMBODIMENT

Figure 1:
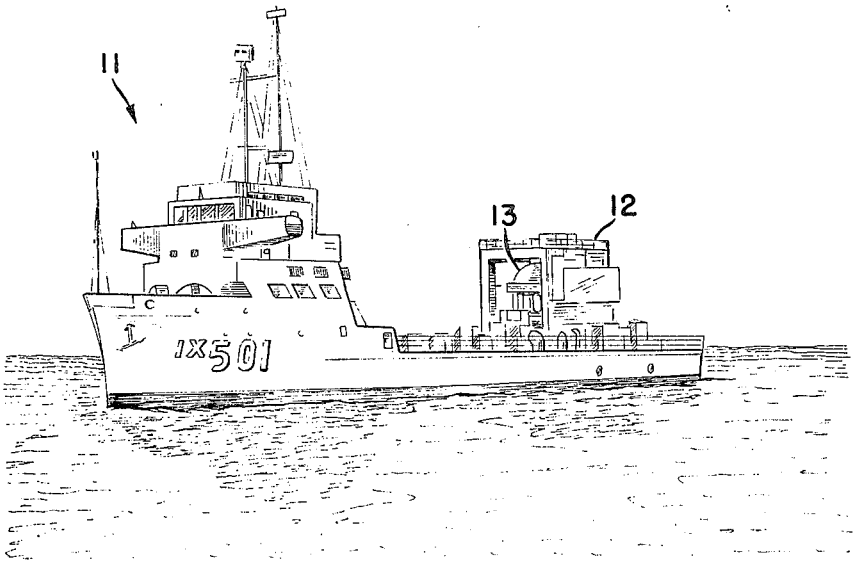
FIG. 1 is a perspective view showing the operational environment of the invention.

Referring to FIG. 1, an oceanographic, deep dive vessel 11 is shown as having a deck mounted crane 12 which supports and moves a personnel transport capsule 13. Although the vessel illustrated is the U.S.N.S, Elk River, IX 501, of course, other oceanographic dive ships may practice the invention. In operation, crane 12 lowers personnel transfer capsule 13 through a well to a depth where work is to be done beneath the surface of the water. Successful work parties have been deployed in this manner to depths exceeding 200 meters. At such depths, the personnel are subjected to extremely high pressures. Decompression from these pressures requires many days during which the ambient pressure is gradually reduced. Because of the small confines provided by personnel transport capsule 13, such decompression is generally accomplished by transferring the personnel from the transport capsule 13 to a suitable decompression chamber.

Figure 2:
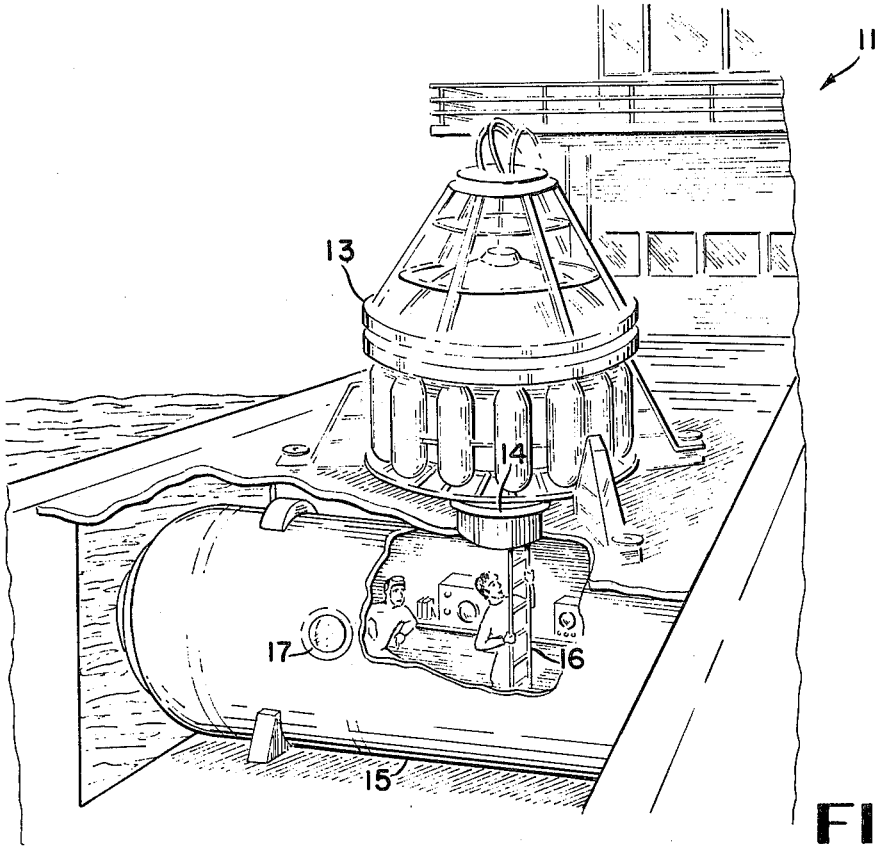
FIG. 2 is a cut-away of the vessel shown in FIG. 1, showing cooperative relationships between a decompression chamber and a personnel transfer capsule.

Referring to FIG. 2, an arrangement for this decompression is used on the vessel of FIG. 1 is shown. Capsule 13 is attached to a suitable hatch 14 which extends through the weather deck of vessel 11 to communicate with a decompression chamber 15, which is larger and can accommodate several divers comfortably. Access to decompression chamber 15 is by conventional air lock within hatch 14 and a vertically extending ladder 16. In order for the personnel within decompression chamber 15 to be studied and to visually communicate with ship's personnel, viewing ports 17 are positioned at predetermined places so as to extend through the hull of the decompression chamber 15. Similarly, viewing ports, not shown, may be provided in the upper surface of personnel transport capsule 13 such that diving personnel may view the waters immediately adjacent the personnel transport capsule.

Although initially pressure-tight, viewing ports 17 develop leaks after periods of use. These leaks are occasioned by the pitting or metallic errosion between the mechanical seals holding the transparent portion of viewing port 17 to the hull of the chamber or vessel in which it is installed. This pitting is due to a variety of causes, including caustic environment and exposure to moisture and salt laden air in a fashion all too familiar to those having an acquaintance with the sea.

Figure 3A:
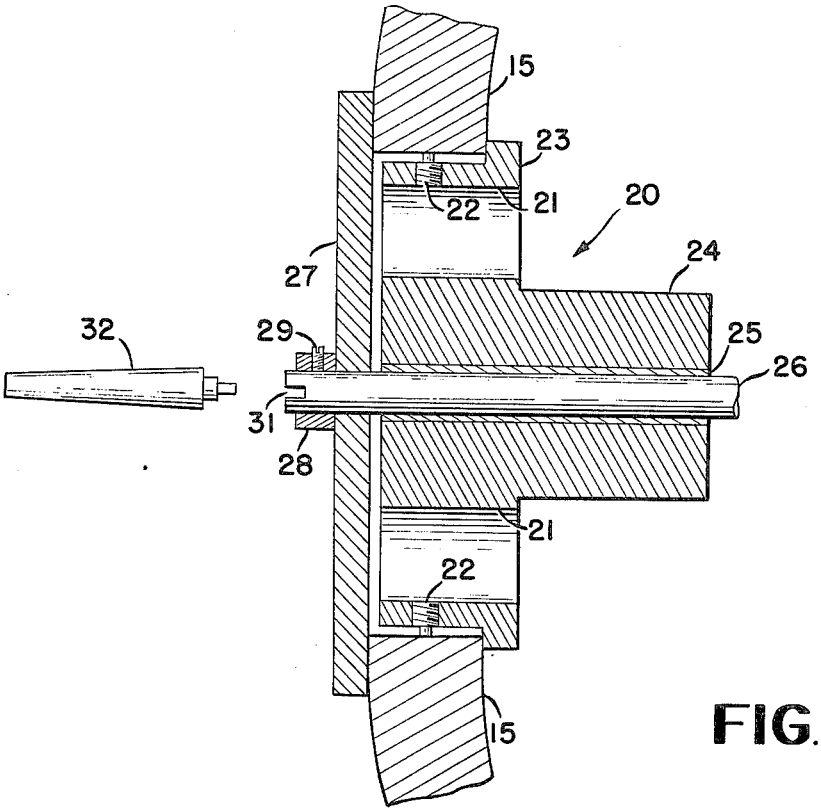
FIGS. 3*a* through 3*d* are sectional views taken through the hull of a decompression chamber in the vicinity of a viewing port with the refurbishing tool of the invention installed therein.

Referring to FIG. 3*a*, refurbishing system of the invention will be described as illustrated in a sectional view taken through the hull of decompression chamber 15 as it is undergoing refurbishment. Of course, as noted above, the system of the invention is equally applicable to the personnel transport capsule 13 or other deep submergence hulls.

As may be readily seen, a guide 20 is inserted in the aperture where viewing port 17 is fitted and centrally positioned therein. A plurality of apertures 21 extend through guide 20 and threadably receive nylon tipped Allen headed screws 22. Screws 22 are extended to centrally position guide 20 within the port aperture and a flange 23 carried thereon engages the marginal portions of the port to further establish a datum axis. Thus, screws 22 provide a positioning means. An Oilite bearing 25 is carried by guide 20 and extends centrally therethrough to rotably support a shaft 26 therein. Although bearing 25 in developmental models is of a bronze, Oilite type, another bearing surface such as Teflon might be used, if desired. A facing or grinding plate 27 is secured on the outer end of shaft 26 by means of a boss 28 and cooperating set screw 29. A square drive socket 31 in the distal end of shaft 26 receives a drive arbor or quill 32 for rotary movement of the assembly by a suitable hand drill or other tool, not shown.

Thus, it may be seen that guide 20 centers and permits driving engagement of grinding plate 27.

Grinding plate 27 is fabricated from cast iron or other suitable material and is urged into grinding or lapping engagement with the workpiece, the outer surface of decompression chamber 15.

Guide 20 may be made of magnetic material which is permanently magnetized to facilitate mounting on the hull of chamber 15 and provide by means of magnetic attraction, and engaging force to urge grinding plate 27 into engagement with hull 15.

Apertures 21 serve to lighten guide 20, provide access to set screws 22, and control the amount of magnetic attraction exerted on grinding plate 27.

Figure 4:
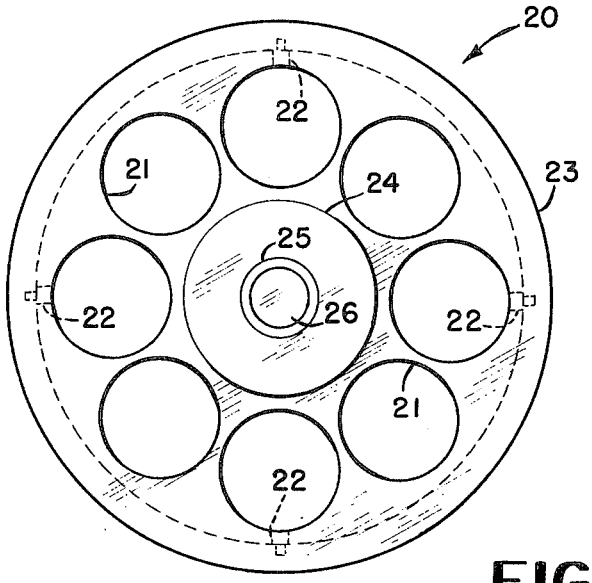
FIG. 4 is a plane view of a pressure plate guide shown in FIG. 3*a;*.

Referring to FIG. 4, the details of guide 20 may be more readily understood. As shown, apertures 21 are arranged concentrically throughout the center boss 24 to provide a ring of axially parallel apertures. Although eight such apertures are shown, more or less may be employed in dependence upon the design choice of the fabricating person. Similarly, although four Allen head screws 22 are shown, as few as three or as many as eight may be used in the embodiment shown in FIG. 4, if desired.

Figure 5:
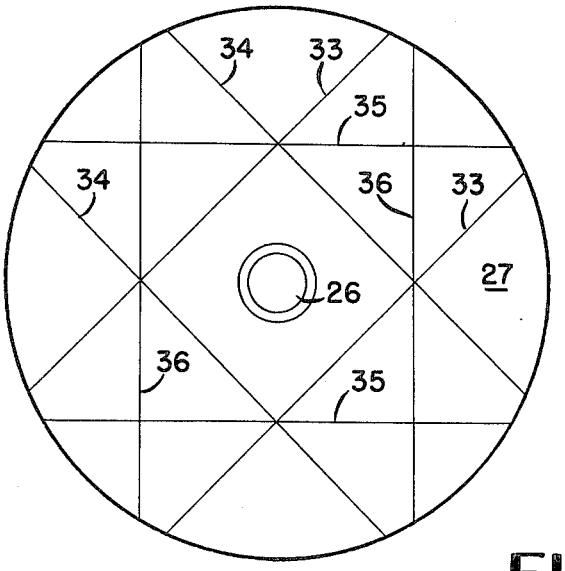
FIG. 5 is a plan view of the grinding tool shown in FIG. 3*a*.

Referring to FIG. 5, the details of lapping plate 27 are more clearly shown. Lapping plate 27 is a disc of cast iron and has a plurality of cannelures arranged thereon as intersecting parallel patterns. Thus, cannelures 33 intersect with cannelures 34 to provide a grid which is repeated in a different spaced rotation by cannelures 35 and 36. Cannelures 33 through 36 serve the purpose of providing for removal of spent abrasive and removed material.

Figure 3B:
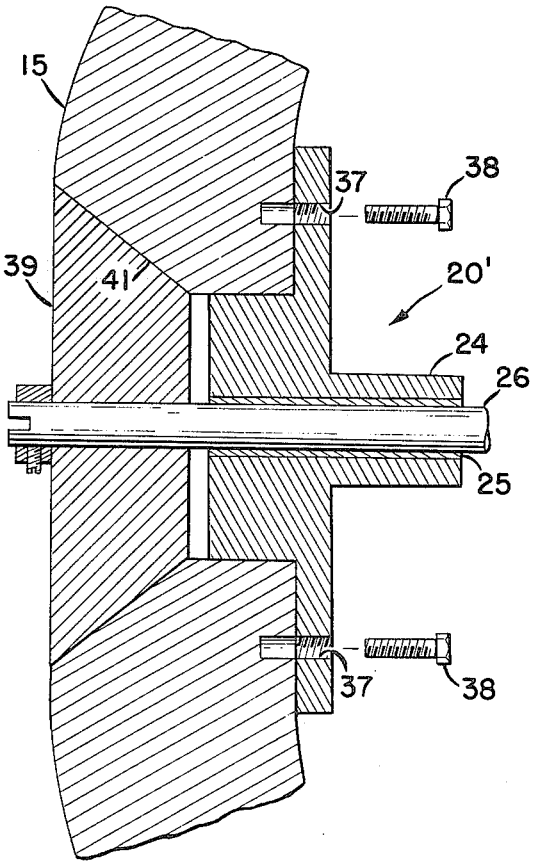

Referring to FIG. 3*b*, a variation of the refurbishing system is shown for use with conical ports, essential elements remain the same and cooperate in the same fashion as the variation previously described in FIG. 3*a*. It will be observed that guide 20′ has a plurality of threaded apertures 37 therein which cooperate with a threaded bolt 38 to jack guide 20′ away from hull 15. This jacking makes removal and installation of the guide a one man operation which, due to the strength of the magnetic attraction, would be impossible without this jacking arrangement.

Similarly, lapping tool 27 has been replaced with a conical lapping tool 39 which is machined such that conical face 41 thereof has a desired contour of the finished port. Of course, face 41 may include a plurality of cannelures such as previously discussed in connection with FIG. 5.

Figure 3C:
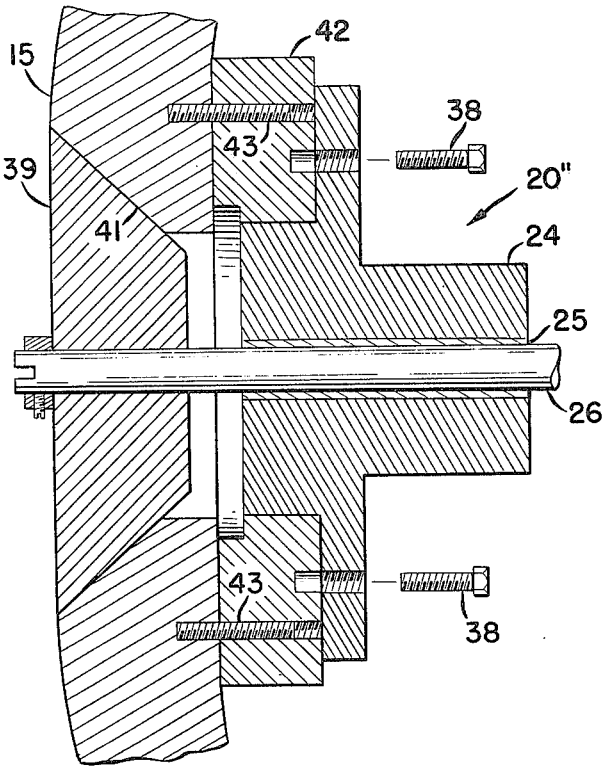

Referring to FIG. 3*c*, an alternative arrangement is shown for use where hull 15 is made of a non-magnetic material, such as aluminum, for example. In this instance, a magnetic mounting ring 42 is secured to hull 15 by threaded fasteners 43 which cooperate with preexisting or deliberately installed apertures connected with the viewing port. Mounting ring 42, in turn, provides a magnetic fastening point for guide 20′ which employs jacking screws 38 discussed in connection with FIG. 3*b* for attachment and removal. Of course, guide 20″ supports shaft 26 by sleeve bearing 25 as previously discussed. Thus, ring 42, together with fasteners 43 provide a positioning means to position guide 20″ in an indexed position.

It should also be noted that although the conical tool 39 is shown attached to shaft 26, the disc lapping tool 27 may be used, if desired, in dependence upon the type of sealing required by the port.

Figure 3D:
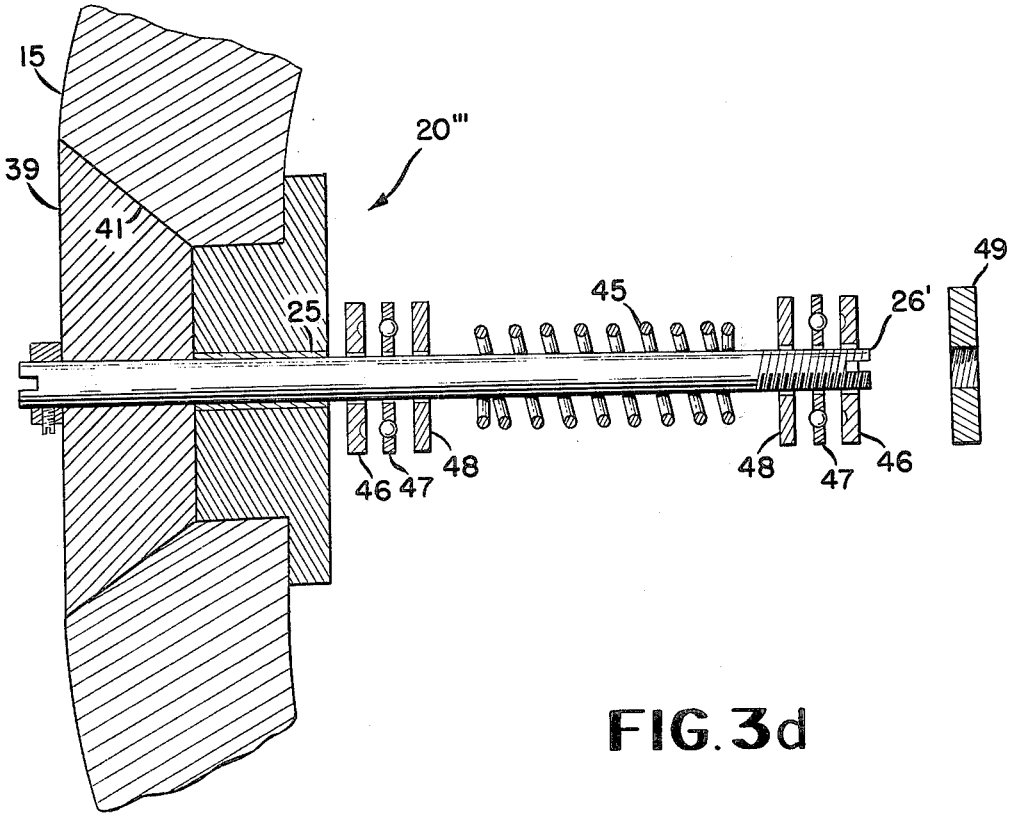

Referring to FIG. 3*d*, an alternative method of providing lapping pressure is illustrated. In this instance, it will be observed that shaft 26′ extends beyond the sleeve bearing 25 to receive bearing race 46 which cooperates with a caged mechanical bearing 47 and a thrust washer 48 to provide an engagement point for a compressed resilient spring 45. The outboard end of spring 45 is similarly provided with a thrust washer 48 caged mechanical bearing 47, and bearing race 46. Spring 45 is compressed by means of a thrust nut 49 which is threadably received on the outboard end of shafts 26′. In this fashion spring 45 is supported about shaft 26′.

As will be observed in FIG. 3*d*, both ends of shaft 26′ are provided with driving connections. Of course, this arrangement may be also used with the variations of the system illustrated in FIGS. 3*a* through 3*c*.

MODE OF OPERATION

The refurbishing system of the invention operates by use of known grinding and lapping techniques and employs a paste abrasive between the grinding and lapping tools 27 or 39 and the area being refurbished. The viewing port is first disassembled and the glass lens removed such that the tool of the invention may be assembled thereon. Guide 20 is placed on hull 15 and positioned by means of screws 22 or, in the case of the alternative variations discussed with connection with FIG. 3*c*, on the mounting ring 42 which has previously been placed in engagement with hull 15. Lapping tool 27 or 39 is then coated with the necessary abrasive and shaft 26 inserted in guide 20 and in engagement with bearing 25. Engagement pressure is provided either via magnetic attraction, manual pressure, or the tension provided by spring 45.

Driving engagement is then made with shafts 26 and rotation of the tool in the driving and lapping operation commences. Driving operation continues until the finish is obtained in the conventional fashion. That is, different grinding stages employing different grades of abrasive are serially performed until an adequate seal is obtained. It should be noted that in the initial development of the invention aboard the Elk River, a finish exceeding that of number 32 machine finish was obtained.

Upon completion of the lapping, the lapped and ground area are carefully cleaned to remove excess abrasive and any oils which would be dangerous in the high pressure environment which the chamber and personnel transport capsules are used. The view port is then carefully reassembled and tested for leak tightness.

The foregoing description taken together with the appended claims constitutes a disclosure such as to enable a person skilled in the marine engineering and metal working arts and having the benefit of the teachings contained herein to make and use the invention. Further, the structure herein described meets the objects of the invention and generally constitutes a meritorious advance in the art unobvious to such artisans not having the benefit of these teachings.

Obviously, many modifications and variations are possible in the light of the above teachings, and, it is therefore understood that the invention may be practiced otherwise than as specifically described.

What is claimed is:

1. An in situ refurbishing system for viewing ports in a hull having a high pressure sealing capacity comprising:

positioning means configured for attachment to said hull in a predetermined relationship thereto for establishing a datum axis with respect to a viewing port therein;

guie means removably attached to said positioning means for establishing an axis of revolution passing through the center of said viewing port;

a shaft passing through said guide means and rotatably supported thereby;

facing tool means rigidly attached to said shaft rotation therewith and positioned substantially on the side of the hull opposite said guide means;

driving means engaging said shaft for providing rotational drive therefor; and magnetic pressure means effectively connecting said positioning means and said facing tool means for urging them toward one another such that said facing tool means is held in engagement with said hull to refurbish said hull with respect to said datum axis.

2. An in situ refurbishing system according to claim 1 in which said positioning means is held in fixed relation to the hull by threaded fasteners.

3. An in situ refurbishing system according to claim 2 in which the aforesaid guide means is attached to said positioning means by magnetic attraction.

4. An in situ refurbishing system according to claim 1 in which said facing tool means is cylindrically shaped and having work engaging surfaces on at least one base thereof with patterns of intersecting cannelures thereon.

5. An in situ refurbishing system according to claim 3 in which said pressure means includes a plurality of aperatures extending axially through said guide means to regulate the magnetic force between said guide means and said facing tool.

6. An in situ refurbishing system according to claim 5 in which said driving means includes a square drive adapted for selective coupling to a rotary motor hand tool.

* * * * *